US005290156A

United States Patent [19]

Mayland

[11] Patent Number: 5,290,156

[45] Date of Patent: Mar. 1, 1994

[54] WALKING BEAM COMPRESSOR ASSEMBLY

[76] Inventor: Harold E. Mayland, 7811 S. Ventura Ct., Aurora, Colo. 80016

[21] Appl. No.: 737,059

[22] Filed: Jul. 29, 1991

[51] Int. Cl.[5] ..... F04B 17/00

[52] U.S. Cl. ..... 417/415; 403/147

[58] Field of Search ..... 417/415; 403/387, 388, 403/147, 79, 158, 163; 384/192, 203

[56] References Cited

U.S. PATENT DOCUMENTS

| | | | |
|---|---|---|---|
| 1,033,414 | 7/1912 | Kahn | 403/387 |
| 1,775,733 | 9/1930 | Phipps . | |
| 2,113,562 | 4/1938 | Mason | 255/16 |
| 3,655,301 | 4/1972 | McClung | 417/437 |
| 4,345,734 | 8/1982 | Studinger | 248/669 |
| 4,530,646 | 7/1985 | McCoy | 417/464 |
| 4,557,351 | 12/1985 | Yolk | 184/18 |
| 4,653,381 | 3/1987 | van Os | 92/148 |
| 4,802,422 | 2/1989 | Beard | 403/387 |
| 5,052,824 | 10/1991 | Van Wyk | 384/192 |
| 5,074,698 | 12/1991 | Lippert | 403/79 |

*Primary Examiner*—Richard A. Bertsch
*Assistant Examiner*—Alfred Basichas
*Attorney, Agent, or Firm*—John E. Reilly

[57] ABSTRACT

A pumping unit is of the type having a compressor made up of a cylinder and piston extending between a walking beam and samson post, opposite connecting end portions of the compressor clampingly engaging the walking beam and samson post, respectively, and spherical bearing members of the non-lubricating type are disposed in each of the connecting end portions to undergo universal movement in response to any lateral displacement or side loading of the walking beam.

10 Claims, 2 Drawing Sheets

WALKING BEAM COMPRESSOR ASSEMBLY

This invention relates to oil and gas well pumping units; and more particularly relates to a novel and improved compressor assembly and its connection to a downhole pumping unit.

BACKGROUND AND FIELD OF INVENTION

It is customary to mount a pump or compressor between the walking beam and a stationary portion of a pump jack for a downhole pumping unit. Among other problems associated with such systems is the side loading imparted by the walking beam through the pump or compressor and particularly at the connecting ends which can impart a great deal of stress or strain to the working elements of the pump or compressor. A somewhat associated problem has to do with the manner of connection of each end of the pump or compressor between the walking beam and stationary portion, such as, the leg of a samson post and which in the past has required some form of permanent connection, such as, by welding or bolted connections through openings in the connecting members.

Representative of the systems which have been employed in the past is that disclosed in U.S. Pat. No. 4,530,646 to C. D. McCoy in which swiveled connections are utilized for mounting the compressor to a walking beam and lower samson post as well as to permit lengthwise adjustment to vary the support point for the lower end of the piston rod to the samson post; however, in McCoy, the swivel axes are arranged at right angles to one another in an effort to compensate for any misalignment and requires direct bolted attachment to the walking beam and samson post. In U.S. Pat. No. 3,665,301 to C. F. McClung, swivel connections are provided at opposite ends of the compressor which are broadly described as being in the form of knuckle joints, and a buckle type of adjuster is utilized between the lower end of a cylinder and a lower swivel joint. U.S. Pat. No. 4,345,734 to J. Studinger discloses a telescoping inner and outer post arrangement for a walking beam compressor. Other representative patents are U.S. Pat. Nos. 1,775,773 to J. T. Phipps, 2,113,562 to R. C. Mason and 4,557,351 to R. D. Volk.

There continues to be a need for a novel and improved form of connection between the pump or compressor and connecting ends on the pumping unit so that any side loading or lateral displacement can be most effectively absorbed through the connecting ends and at the same time avoid the necessity of lubrication of the bearings; also, to avoid the necessity of any permanent or positive attachment at the connecting ends.

SUMMARY OF INVENTION

It is therefore an object of the present invention to provide for a novel and improved compressor assembly which is adaptable for releasable but secure engagement to a jack in an efficient and highly dependable manner.

Another object of the present invention is to provide in a walking beam compressor assembly for a novel and improved non-lubricated bearing for interconnection between opposite ends of the compressor assembly and a pump jack and specifically the walking beam and samson post of a pump jack in such a way as to establish universal coupling therebetween.

It is a still further object of the present invention to provide in a walking beam compressor assembly for a novel and improved clamping assembly which can be quickly and adjustably attached to different points of a pump jack while avoiding any permanent means of attachment, such as, by welding.

It is an additional object of the present invention to provide for a novel and improved walking beam compressor assembly for a pump jack which requires minimum maintenance and down time both in installation and operation and which will effectively absorb any side loading of the pump jack when operated and which is highly versatile and conformable for use virtually with any type of walking beam pumping unit.

In accordance with the present invention, an end bearing assembly has been devised for attaching a pump or compressor between a walking beam and stationary part of a pumping unit wherein the compressor includes a cylinder and piston with a piston rod extending from one end of the cylinder and terminating in a free connecting end portion along with an elongated fitting extending from an opposite end of the cylinder and terminating in an opposite connecting end portion, the assembly comprising support means at one connecting end for connection of the compressor to one of the walking beam and base, a shaft member extending through the one connecting end portion for connection in journaled relation to the support means, an inner general spherical bearing member having a central bore through which the shaft is inserted, and outer bearing means in the one connecting end portion including a sleeve in partially surrounding relation to the inner bearing member, the outer bearing means supporting the inner bearing member for rotation in response to reciprocation of the walking beam.

In the preferred form, the inner bearing is composed of metal and the sleeve of the outer bearing means is composed of a low friction, non-metallic material. The support means in turn preferably takes the form of an end plate which is engageable with a flat surface on the walking beam and clamping members for clamping the end plate against the flat surface of the walking beam. The bearing assembly as described including the support means can be employed at both ends of the compressor and effectively establish universal coupling between the connecting ends and pumping unit.

The above and other objects, advantages and features of the present invention will become more readily appreciated from a consideration of the following detailed description of a preferred embodiment thereof, when taken together with the accompanying drawings, in which:

DETAILED DESCRIPTION OF THE PREFERRED EMBODIMENT

Figure 1:
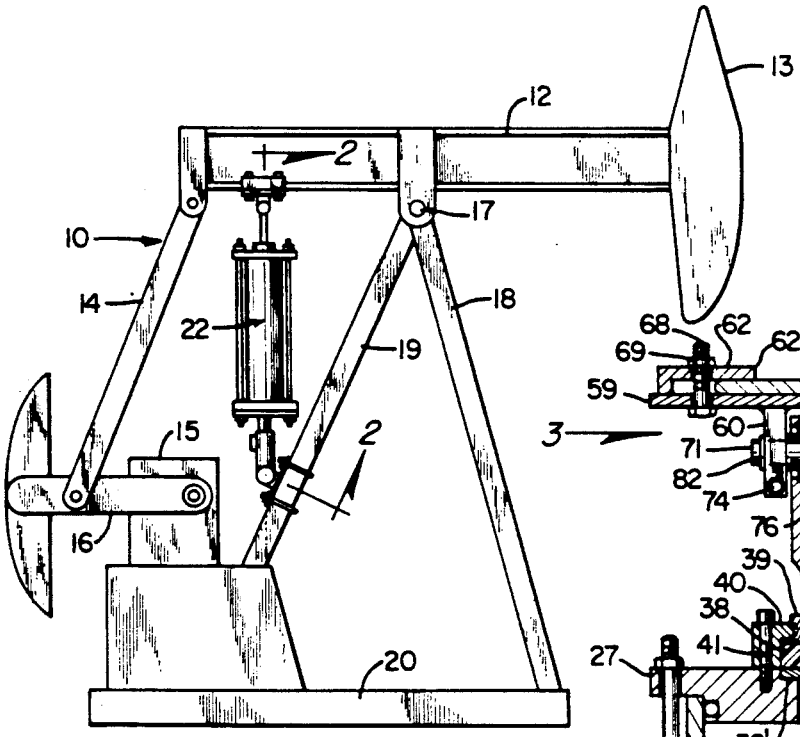
FIG. 1 is a side view in elevation illustrating a preferred form of compressor assembly on a walking beam pump jack unit.
Figure 2:
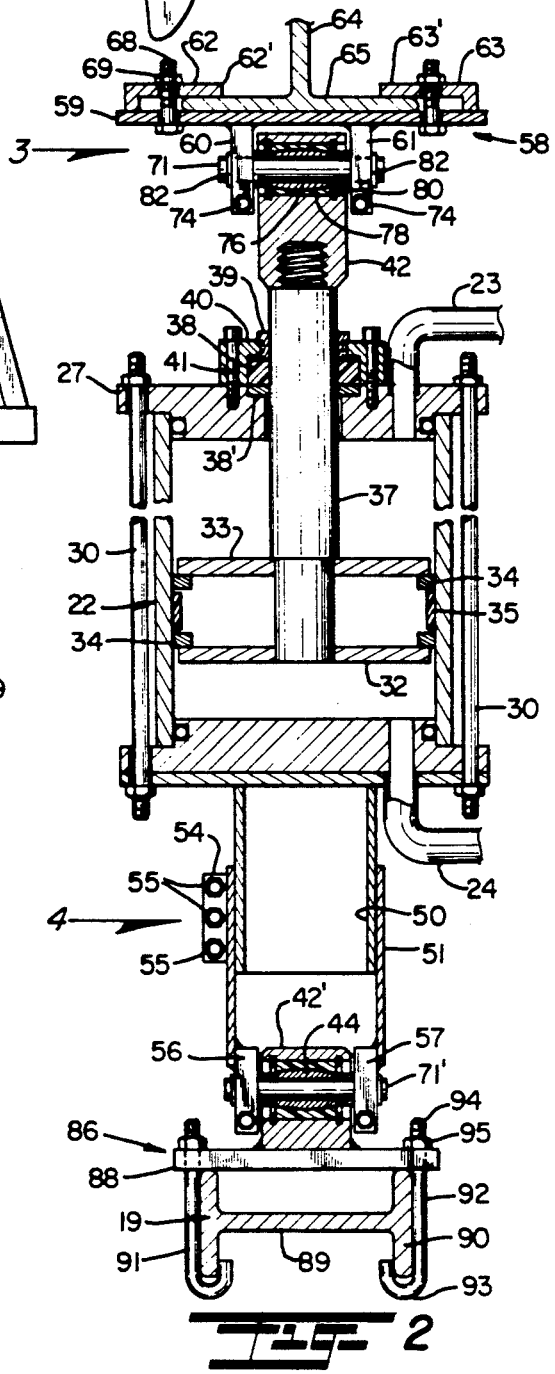
FIG. 2 is an enlarged cross-sectional view taken about lines 2—2 of FIG. 1.
Figure 5:
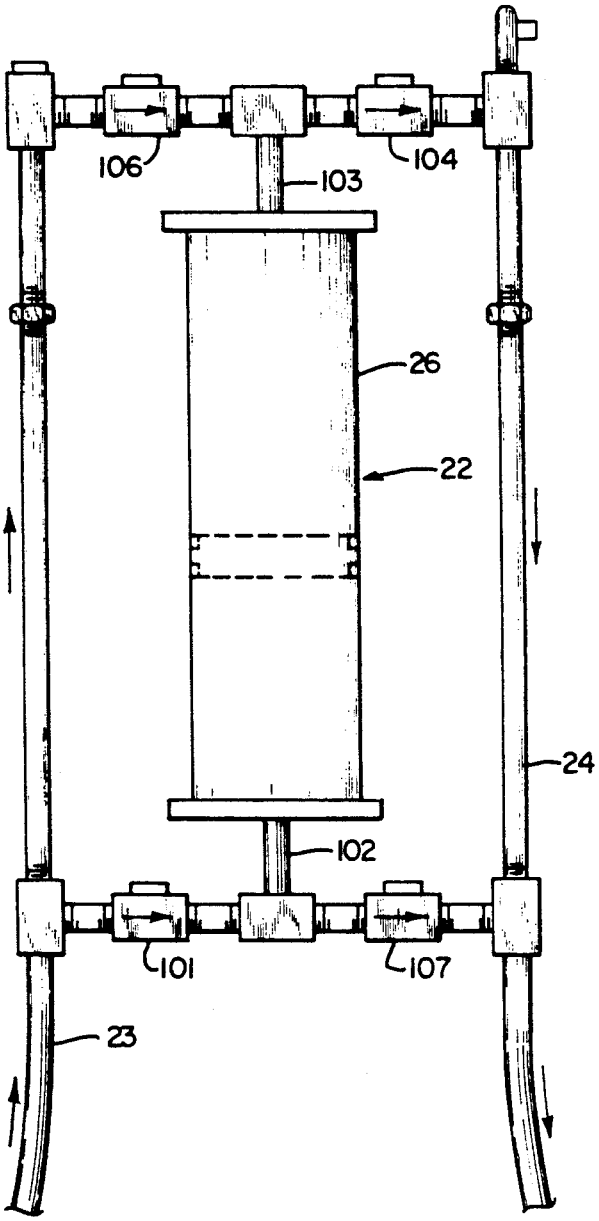
FIG. 5 is a view schematically illustrating the fluid flow lines of the compressor assembly shown in FIGS. 1 and 2.

Referring in more detail to the drawings, there is shown by way of illustrative example in FIG. 1 a conventional form of pump jack 10 for a well pumping unit. The jack is broadly comprised of a walking beam 12 having a horsehead 13 at one end and a connecting rod 14 at the opposite end. In a well-known manner, the connecting rod 14 is reciprocated by a motor drive 15 through suitable linkage 16 to oscillate the walking beam 12, and the horsehead 13 is connected to one end of a standard polished rod and sucker rod, not shown, for operating a downhole pumping system. The walking beam 12 is mounted by means of a saddle bearing 17 to a samson post, one leg 18 of the samson post attached to a base or skid 20 and a second leg 19 serving to support a lower end of compressor 22. The compressor 22 is so constructed and arranged as to operate off of the reciprocal motion of the walking beam in compressing the gas as it is removed via intake line 23 from the well and returning it into a sales line via a discharge line 24, as illustrated in FIGS. 2 and 5.

The construction of the preferred form of compressor 22 is given by way of illustration and not limitation and is essentially made up of a double-acting cylinder arrangement comprising a cylinder housing 26, an upper end plate 27 and a lower end plate 28 with a stop member 29. Tie rods 30 are arranged in equally spaced circumferential relation externally of the cylinder housing 26 to extend through the opposite plate members 27, 28 and 29 and are tightened by nut members at each end to draw the end plates into sealed relation to the cylinder housing. A piston 32 has opposite retainer plates 33, and axially spaced seals 34 with a wear ring 35 are interposed between the seals. A piston rod 37 extends upwardly from the piston head through the upper end plate 27 and through a wear ring 38 and seal 38' which are retained in position by a dust cover 39 and cap 40 which is fastened to the end plate 27 by bolts 41. The upper end of the piston rod is threaded onto a clevis eye 42 which includes a novel and improved form of bearing 44 in accordance with the present invention and to be hereinafter described in more detail.

Figure 4:
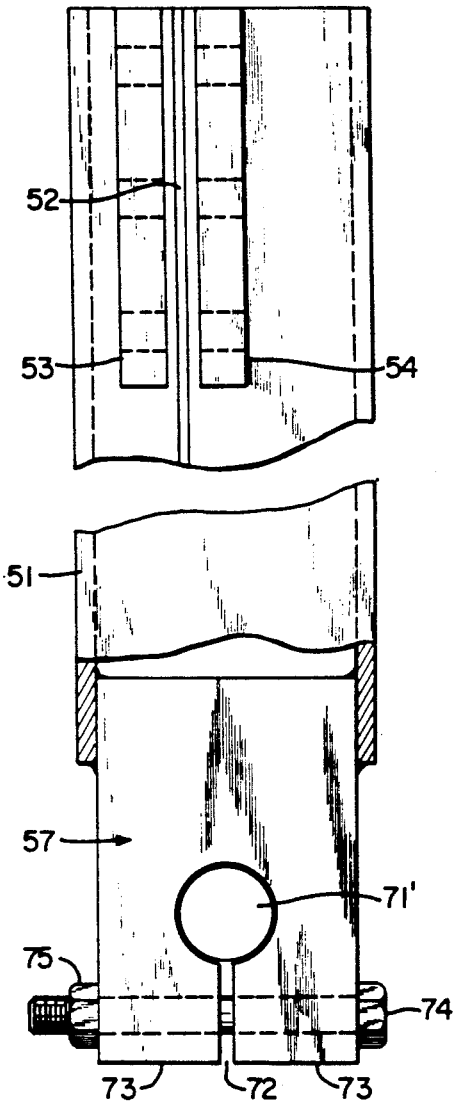
FIG. 4 is an enlarged view of the lower connecting end portion of the compressor assembly taken at line 4 of FIG. 2.

The lower end plate 28 on the cylinder housing includes a downwardly projecting tubular post 50 of a square cross-sectional configuration and which is dimensioned for telescoping insertion into an upwardly extending tubular post 51. As best seen from FIG. 4, the outer tubular post 51 is split along one wall as designated at 52 and is provided with ears 53 and 54 on opposite sides of the split portion 52 with aligned openings for insertion of fasteners 55. The fasteners may suitably be in the form of bolts having threaded ends for reception of nuts so that the ears can be tightened against one another and cause the outer post 51 to frictionally engage the inner post 50 to establish the desired spacing or distance between the cylinder housing 26 and leg 19 of the samson at the lower end of the outer post 51. A pair of spaced mounting brackets 56 and 57 project downwardly from opposite sides of the post 51 for connection to a clevis eye 42' in a manner to be described.

Figure 3:
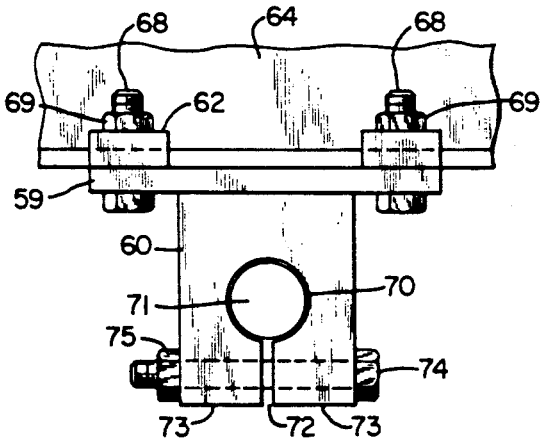
FIG. 3 is a side view enlarged of an upper connecting end portion of the compressor assembly and taken at line 3 of FIG. 2.

It is important that the compressor 22 be so connected between the walking beam 12 and samson post leg 19 or other base member that it will be capable of compensating for any side loading of the walking beam 12 as it reciprocates under the control of the connecting rod 14; also, it is desirable that opposite ends of the cylinder housing 26 and piston 37 be so connected to the samson post and walking beam, respectively, as to avoid installation by welding or otherwise drilling through any of the parts. To this end, an upper clevis assembly 58 is comprised of a flat mounting plate 59, downwardly projecting brackets 60 and 61 to receive the clevis eye 42, and generally L-shaped clamping members 62 and 63 to clamp the mounting plate 59 to the walking beam 12. The walking beam 12 is of generally I-shaped configuration having a central web 64 and a base flange 65 against which the plate 59 bears with the L-shaped clamps 62 and 63 secured by bolt members 68 and nuts 69 to opposite sides of the base flange 65. In this way, the bolt member 68 can extend through aligned openings in the plate 59 and each clamp 62 and 63 so as to tighten free ends 62' and 63', respectively, of the clamps against the flange. As shown in FIG. 3, each of the brackets 60 and 61 includes a central opening 70 for insertion of each end of a stub shaft 71, and a slot 72 is formed in each bracket 60, 61 to extend downwardly from the central opening through the lower portion of each bracket so that the resultant split ends 73 of each bracket can be tightened by drawing in together with a bolt 74 and nut 75.

Again, an important feature of the present invention resides in the use of the non-lubricated, spherical bearing 44. The inner bearing portion is a metal bearing composed of steel and has an external generally spherical bearing surface 76 and a central opening for insertion of the stub shaft 71. The bearing 44 is mounted within an outer bearing liner 78 which is a high strength, self-lubricating liner woven of low-friction TEFLON® and DACRON® fibers reinforced by a filament wound Fiberglass/epoxy material. The bearing liner 78 is housed within a correspondingly sized opening in the upper end of the clevis eye 42. Snap rings 80 are disposed at opposite ends of the liner 78 to bear against opposite squared ends of the inner bearing 44, and metal bushings 82 extend in opposite directions away from the snap rings through the opening 70 in each of the brackets 60 and 61 and in snug-fitting relation to the stub shaft 71.

The clevis eye 42' at the lower end of the post 52 contains a corresponding form of spherical bearing 44 to the upper bearing 44 as described. However, a somewhat modified form of clamping arrangement is required to effect connection between the clevis eye 42' and the samson post 19. For this purpose, a clevis assembly 86 is made up of a mounting plate 88 with the clevis eye 42' extending upwardly between the mounting brackets 56 and 57 which in a manner corresponding to the brackets 60 and 61 for the upper clevis assembly can be tightened around each end of the stub shaft 71' which extends through the bearing 44. The samson post 19 is of generally I-shaped configuration having a central web 89 and flanges 90 at opposite ends of the web but disposed such that the central axis through the web 89 is parallel to the mounting plate 88. Accordingly, the mounting plate 88 is positioned to bear against an edge of each flange 90 but is provided with clamping plates 91 and 92 which traverse an end of each flange 90 and terminate in generally J-shaped end portions 93 to receive opposite ends of the flanges 90 to the ends which bear against the mounting plate 88. Bolt members 94 are in the form of threaded stems which are inserted into mating counterbores, not shown, in the upper end of each of the clamping plates 91 and 92 for upward extension through openings in the mounting plate 88 to receive nuts 95. Tightening of the nuts 95 against the upper surface of the mounting plate will draw the J-shaped ends 93 firmly against the lower or opposite ends of the flanges 90 of the samson post leg 19 to complete the connection between the clevis assembly 86 and the samson post. As best seen from FIG. 1, the clevis assembly 86 is connected at an inclined angle to the longitudinal axis through the compressor 22 while permitting the clevis eye 42' to undergo limited universal movement about the bearing 44 in the same manner as described with respect to the upper clevis eye 42. Characteristically, the compressor assembly will undergo a generally figure-eight movement about its longitudinal axis due to the side loading of the walking beam as the latter travels up and down. In this relation, the degree of movement typically necessary to avoid side loading or stress as applied by the walking beam to the compressor connection is typically on the order of 6°. Of course, any increased movement or release with respect to the longitudinal axis of the bearing may be designed into the respective bearings and clevis assemblies.

There is schematically illustrated in FIG. 5 the fluid flow of a typical compressor 22 in response to reciprocation of the walking beam and which fluid flow may also contribute to the side loading at the connecting ends of the compressor assembly to the walking beam 12 and samson post leg 19. Briefly, on each upstroke of the piston 32, fluid is drawn through the intake line 23, check valve 101 and nipple 102 to the lower end of the cylinder housing 26; and fluid is discharged from the upper end of the cylinder housing 26 via nipple 103, check valve 104 and the discharge line 24 which leads to the sales line. On the downstroke, fluid flows directly from the line 23 through check valve 106 and nipple 103 to the upper end of the cylinder 26; and fluid is discharged from the lower end of the cylinder housing 26 through nipple 102 and check valve 107 to the sales line. In other words, the cylinder assembly acts as a double-acting cylinder but also will impart some degree of side loading to the connecting ends of the compressor and which is absorbed by the spherical bearings 44 in the manner described.

In certain installations, it may be desirable to connect the lower end of the compressor directly to a base or skid, not shown, rather than to the samson post leg 19. In this connection, it will be apparent that the clevis assembly at each end of the compressor 22 may be modified to conform to the fitting to which it is connected and, for example, the assembly 58 employed at the upper end of the compressor similarly may be utilized at the lower end and vice versa. Moreover, in many applications where it is desirable to reverse the extension of the piston rod so as to extend downwardly rather than upwardly away from the cylinder housing, the connecting end fittings may be reversed. Most importantly, no welding or other type of permanent connection is required while minimizing vibration throughout the system.

It is therefore to be understood that while a preferred form of system has been herein set forth and described, various modifications and changes may be made in the construction and arrangement of parts as well as their composition without departing from the spirit and scope of the present invention as defined by the appended claims and reasonable equivalents thereof.

We claim:

1. In pumping unit having a walking beam and base, each of said walking beam and base including a generally I-shaped beam member, each said beam member having a web and flanges normal to said web at opposite ends thereof, and wherein a compressor includes a cylinder and a piston with a piston rod extending from one end of said cylinder and terminating in one connection end portion, and an opposite end of said cylinder terminates in an opposite connection end portion with a bearing assembly in each of said connecting end portions, the improvement comprising:

means for clampingly securing each of said connecting end portions to a respective one of said walking beam and said base including first coupling means for securing said one connecting end portion to said walking beam including end support members at opposite ends of said shaft, said shaft journaled to said end support members, an end plate engageable with a flat external surface of said walking beam; and clamping means for releasably clamping said end plate to said walking beam; and second coupling means for securing said opposite connecting end portion to said stationary part including end support brackets at opposite ends of said shaft, said shaft journaled to said end support members, a mounting plate engageable with said stationary part, and clamping means for releasably clamping said mounting plate to said stationary part including J-shaped ends adjustably connected to said mounting plate, said J-shaped ends each receiving one of said flanges of said stationary part whereby to retain said flanges secured against said mounting plate.

2. In a pumping unit according to claim 1, said first coupling means including an end support member at opposite ends of said shaft, said shaft connected in journaled relation to said end support members.

3. In a pumping unit according to claim 2, including snap rings at opposite ends of said bearing member and bushings at opposite ends of said shaft for insertion into openings in said end support members.

4. In a pumping unit according to claim 1, each said coupling means including an end plate engageable with a flat external surface of said I-beam members, and said clamping means releasably clamping said end plate to each of said I-beam members.

5. In a pumping unit according to claim 4, wherein one of said I-beam members is perpendicular to the other of said I-beam members and wherein each of said I-beam members includes a web and flanges normal to said web at opposite ends thereof and one of said flanges defining the flat external surface of said I-beam members, one of said clamping means having generally L-shaped rigid clamping members extending away from said end plate into overhanging relation to opposite side edges of one of said flanges of said beam member and fastener means for tightening said clamping members against said opposite side edges of said flange without extending through any portion thereof.

6. In a pumping unit according to claim 5, said fastener means extending between said end plate and said clamping members in close proximity to opposite side edges of said flange.

7. In a pumping unit according to claim 1, said end support members being in the form of support brackets attached to said end plate, and means for adjustably tightening said end support members over said bushings.

8. In a pumping unit having a walking beam and a stationary part, each of said walking beam and stationary part including a generally I-shaped beam member, each said beam member having a web and flanges normal to said web at opposite ends thereof, and wherein a compressor includes a cylinder and a piston with a piston rod extending from one end of said cylinder and terminating in one connecting end portion, and an opposite end of said cylinder terminates in an opposite connecting end portion, the improvement comprising:

a non-lubricating bearing assembly in each of said connecting end portions, each said bearing assembly including an inner, generally spherical bearing member, a shaft extending through a central bore in said spherical bearing member, and an outer bearing sleeve having an inner contoured bearing surface complementary to said spherical bearing member and disposed in closely fitting, surrounding relation to said spherical bearing member;

first coupling means for securing said one connecting end portion to said walking beam including end support members at opposite ends of said shaft, said shaft journaled to said end support members, an end plate engageable with a flat external surface of said walking beam, and clamping means for releasably clamping said end plate to said walking beam; and second coupling means for securing said opposite connecting end portion to said stationary part including end support brackets at opposite ends of said shaft, said shaft journaled to said end support members, a mounting plate engageable with said stationary part, and clamping means for releasably clamping said mounting plate to said stationary part including J-shaped ends adjustably connected to said mounting plate, said J-shaped ends each receiving one of said flanges of said stationary part whereby to retain said flanges secured against said mounting plate.

9. In a pumping unit according to claim 8, including telescoping by adjustable tubular post members extending between said opposite end of said cylinder and said opposite connecting end portion, said end support brackets projecting from a free end of said post opposite to said opposite end of said cylinder, said opposite connecting end portion including a clevis eye containing said bearing assembly, said clevis eye mounted on said mounting plate and extending between said end support brackets.

10. In a pumping unit according to claim 8, said one connecting end portion including a clevis eye at one end of said piston rod.

* * * * *